US006135817A

United States Patent [19]

Leeb

[11] Patent Number: 6,135,817

[45] Date of Patent: Oct. 24, 2000

[54] ELECTRIC CONTACT SEALING ARRANGEMENT

[75] Inventor: Karl-Erik Leeb, Djurhamn, Sweden

[73] Assignee: Telefonaktiebolaget LM Ericsson, Stockholm, Sweden

[21] Appl. No.: 08/872,066

[22] Filed: Jun. 10, 1997

[30] Foreign Application Priority Data

Jun. 14, 1996 [SE] Sweden ..... 9602359

[51] Int. Cl.[7] ..... H01R 13/648

[52] U.S. Cl. ..... 439/608; 174/194

[58] Field of Search ..... 174/139, 145, 174/154, 165, 194; 439/76.1, 79, 607, 608; 264/261, 262, 263, 271.1, 272.11, 272.15, 275, 277

[56] References Cited

U.S. PATENT DOCUMENTS

| | | | |
|---|---|---|---|
| 3,271,726 | 9/1966 | Pfendler | 439/76.1 |
| 4,187,481 | 2/1980 | Boutros . | |
| 4,451,107 | 5/1984 | Dola et al. . | |
| 4,723,196 | 2/1988 | Hofmeister et al. | 361/399 |
| 4,775,333 | 10/1988 | Grider et al. | 439/736 |
| 5,040,994 | 8/1991 | Nakamoto et al. | 439/76 |
| 5,181,864 | 1/1993 | Wakino et al. | 439/620 |
| 5,213,522 | 5/1993 | Kojima | 439/620 |
| 5,286,920 | 2/1994 | Fassel et al. | 174/51 |
| 5,438,160 | 8/1995 | Batty | 174/52.1 |
| 5,507,659 | 4/1996 | Sumida et al. | 439/157 |
| 5,554,037 | 9/1996 | Uleski | 439/76.1 |
| 5,814,765 | 9/1998 | Bauer et al. | 361/658 |

FOREIGN PATENT DOCUMENTS

| | | |
|---|---|---|
| 0 002 890 | 11/1979 | European Pat. Off. . |
| 0 239 424 | 9/1987 | European Pat. Off. . |
| 0 382 148 | 8/1990 | European Pat. Off. . |
| 94/09535 | 4/1994 | WIPO . |

*Primary Examiner*—Angela Ortiz
*Attorney, Agent, or Firm*—Burns, Doane, Swecker & Mathis, L.L.P.

[57] ABSTRACT

An arrangement for sealed contact devices and a method of producing the arrangement by laminating a centring device (6) to a barrier layer (4) and conductor pins (1) centred and guided therein with an adhesive plastic material (8), and by forming a combined lid and contact device which is electrically screening and impervious to moisture.

5 Claims, 1 Drawing Sheet

ELECTRIC CONTACT SEALING ARRANGEMENT

FIELD OF INVENTION

The present invention relates to an arrangement for sealed electric contact devices and to a method for its manufacture.

DESCRIPTION OF THE BACKGROUND ART

Electrical contact devices are vulnerable to humid environments and readily corrode. Modern electronics often operate at such high frequencies as to require the contact devices to be also screened. When screens are used in contact devices, they are often constructed of O-rings and like devices. These devices are bulky, do not seal against radio radiation and are not impervious to the ingress of moisture by diffusion. The attachment of the contact devices to the circuit board constitutes a weak point with regard to both radiation and moisture. Electrical contact devices are often expensive precision engineering structures.

SUMMARY OF THE INVENTION

The object of the invention is to overcome the problems associated with established techniques.

The invention will now be described in more detail with reference to preferred exemplifying embodiments thereof and a also with reference to the accompanying drawing.

DETAILED DESCRIPTION OF PREFERRED EMBODIMENTS

Figure 1:
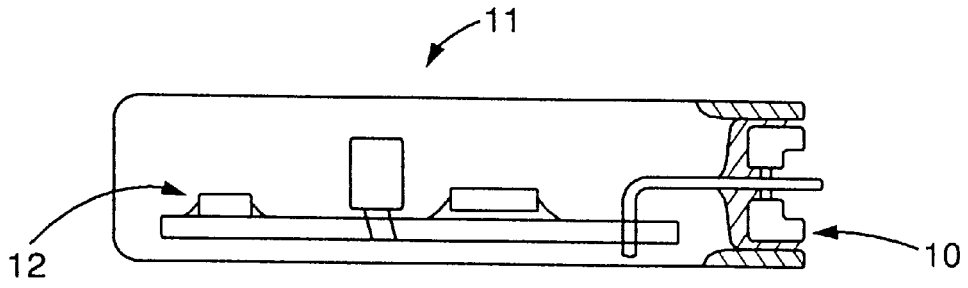
FIG. 1 is a cross-sectional view of the invention mounted in a capsule with an electronic circuit.
Figure 2:
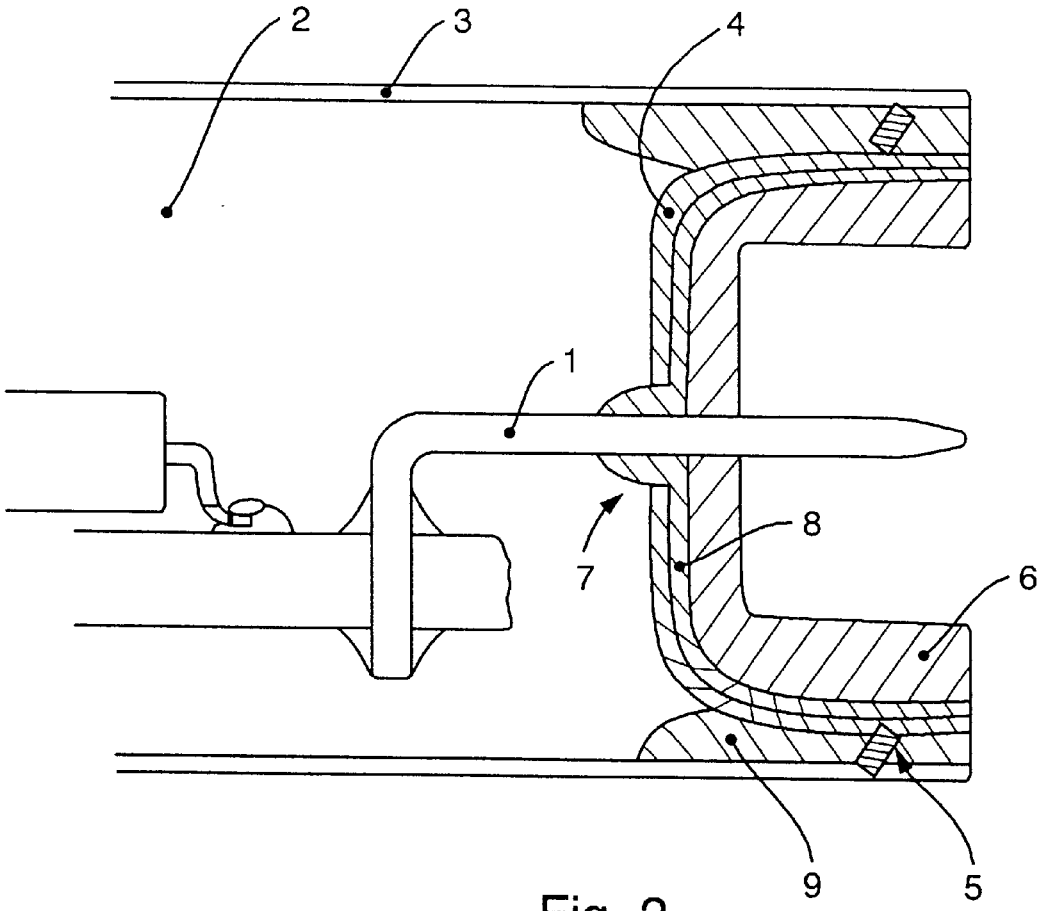
FIG. 2 is an enlarged cross-sectional view of the invention.

The present invention provides an arrangement which enables the transit of electrically conductive pins 1 from a space 2 enclosed by a capsule 3, wherein the capsule is comprised of a moisture-impervious and electrically conductive material, preferably metal, and with which a barrier layer 4 formed integral with the arrangement is electrically contacted by penetration means 5. An electrically insulative centering means 6 guides the electrically conductive pins 1 in the centre of the holes 7 visibly located in the metallic barrier layer 4, so as to prevent the pins 1 from coming into electric contact with each other or with the screen-tight casing formed by the capsule 3 and the barrier layer 4. The space between the centring means and the barrier layer 4 is filled with a plastic material 8 that adheres to and seals around the conducting pins 1, even in the joint between the barrier layer 4 and the capsule filled with sealing material 9, which may be metal solder or plastic. The arrangement comprising the centring means 6, the barrier layer 4 and the centred pins 1 form a combined lid and contact device 10 that is practically impervious to moisture diffusion for instance, with the capsule 11 forming an impervious screen and moisture-impervious enclosure around the electric circuit 12.

The joints 8, 9 may be filled with an ionomer resin (erg. DuPont SURLYN) to achieve a rapid and simple enclosure, wherein the unique ability of the ionomer resin to generate an ion attraction to the oxide layers present on the barrier layer 4 and the capsule 3 ensure moisture-safe bonds and therewith provide a moisture impervious joint. The capsule 3 may be comprised of a laminate of metal foil and ionomer resin in accordance with known principles, to provide a quick and secure enclosure.

All metals that form oxide layers bind effectively to ionomer resin, and the centring means 6 may comprise a polyamide that also forms effective bonds with ionomer resin.

It will be understood that the invention is not restricted to the aforedescribed and illustrated embodiments thereof, and that modifications can be made within the scope of the following claims.

What is claimed is:

1. A contact device comprising:

at least one pin conductor, a metal barrier layer having a hole therethrough, said pin conductor being located in said hole;

an insulating centering device substantially centering said pin in said hole; and an adherent insulating filling material adhered to the pin conductor and the metal barrier layer to define a screening and substantially diffusion-tight lid and contact device combination that can be joined to a capsule, said insulating filling material electrically insulating said pin conductor from said barrier layer, said insulating filling material being an ionomer resin layer and located between the barrier layer and the centering device and filling interspaces between said pin conductor and said barrier layer;

wherein the insulating centering device is injection-molded from polyamide and the barrier layer is a deep-drawn metal plate.

2. The contact device according to claim 1, wherein the insulating centering device and the adherent insulating filling material are an integral unit made of the same material.

3. An arrangement according to claim 1, wherein the adherent filling material is an ionomer resin.

4. An arrangement according to claim 3, wherein the centering device is made of polyamide.

5. An arrangement according to claim 1 wherein the ionomer resin layer is injected-moulded.

* * * * *